United States Patent [19]

Mitsui et al.

[11] Patent Number: 4,527,964

[45] Date of Patent: Jul. 9, 1985

[54] SCROLL-TYPE PUMP

[75] Inventors: Takao Mitsui, Aichi; Hideaki Sasaya; Mitsuo Inagaki, both of Okazaki, all of Japan

[73] Assignee: Nippon Soken, Inc., Nishio, Japan

[21] Appl. No.: 538,571

[22] Filed: Oct. 3, 1983

[30] Foreign Application Priority Data

Nov. 16, 1982 [JP] Japan ..... 57-201561

[51] Int. Cl.[3] ..... F01C 1/04; F04C 18/04

[52] U.S. Cl. ..... 418/55; 418/59

[58] Field of Search ..... 418/54, 55, 59, 56

[56] References Cited

U.S. PATENT DOCUMENTS 1,378,065 5/1921 Varley ..... 418/59

2,841,089 7/1958 Jones ..... 418/55

FOREIGN PATENT DOCUMENTS 486192 5/1938 United Kingdom ..... 418/55

*Primary Examiner*—John J. Vrablik

*Attorney, Agent, or Firm*—Cushman, Darby & Cushman

[57] ABSTRACT

A scroll-type pump suitably used as a compressor in an automobile air-conditioning system. The pump is provided with a stationary scroll member and a movable scroll member, which movable scroll member rotates while maintaining contact with the stationary scroll member. A scroll shape of each of the scroll members is formed by a plurality of alternately arranged arc sections of a small radius of curvature and arc sections of a large radius of curvature smoothly connected to each other. A pump having an overall shape which corresponds to the shape of the space in which the pump is to be arranged in the vehicle is obtained.

10 Claims, 12 Drawing Figures

SCROLL-TYPE PUMP

BACKGROUND OF THE INVENTION

1. Field of the Invention

The present invention relates to a scroll-type pump adapted for use as a compressor for a coolant in, for example, an automobile air-conditioning device.

2. Description of the Prior Art

A so-called scroll-type compressor includes a stationary scroll member and a movable scroll member of the same shape arranged so that they are angularly spaced from each other at an angle of 180°. The movable scroll member rotates about an axis other than its own axis while maintaining contact with the stationary scroll member. Closed chambers formed between the stationary scroll member and the movable scroll member are increased or decreased in volume during the rotation of the movable scroll member. As a result, a fluid medium sucked into the closed chambers is compressed.

In this type of compressor of the prior art, the scroll shape of the scroll members is based on an involute curve based on a circle, a polygon, or a straight line. In this case, the radius of curvature of the scroll member becomes larger as the distance of the scroll member from the center of the scroll increases. The overall shape of a pump having a scroll shape based on the above curves is naturally a substantially circular pillar shape. Thus, if such a pump is housed in a space other than a circular pillar shaped space, such as a trigonally shaped space, it is impossible to effectively use the space.

SUMMARY OF THE INVENTION

An object of the present invention is to provide a scroll-type pump having such an overall shape that it can be arranged in a predetermined shaped space with a high space efficiency.

According to the present invention, there is provided a scroll-type pump comprising:

a housing assembly;

a stationary scroll member fixedly arranged in the housing assembly;

a movable scroll member movably arranged in the housing assembly;

means for supporting the movable scroll member in such a manner that the movable scroll member rotates around an axis other than its own axis while maintaining contact with the stationary scroll member;

chambers being formed between the stationary scroll member and the movable scroll member and each chamber moving circumferentially and radially inward while the volume thereof is gradually decreased when the movable scroll member rotates;

means for introducing a fluid into each chamber when the volume thereof is large; and means for removing fluid from each chamber when the volume thereof is small;

each scroll member having a shape comprised of arc sections of a small radius and arc sections of a large radius alternately arranged and smoothly connected to each other.

DESCRIPTION OF THE PREFERRED EMBODIMENTS

Figure 1:
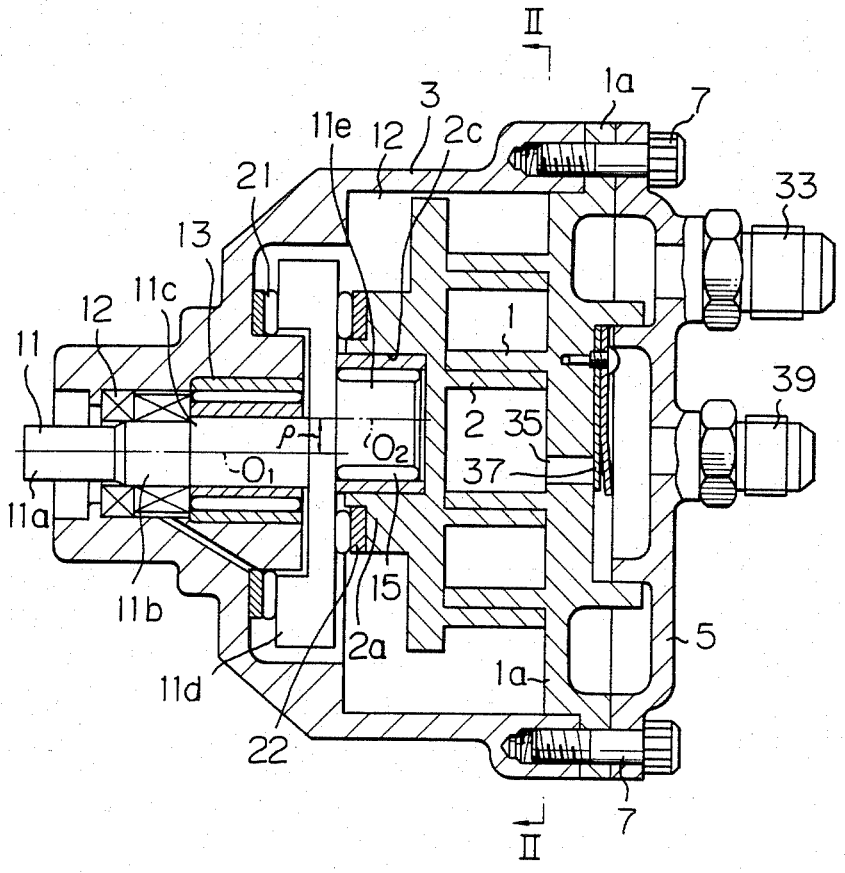
FIG. 1 is a longitudinal cross-sectional view of an embodiment of a scroll-type pump according to the present invention.

The present invention is now described with reference to the attached drawings. In FIG. 1, reference numerals 1 and 2 designate a stationary scroll member and a movable scroll member, respectively. The stationary scroll member 1 has a peripheral portion 1*a* which is arranged between a front housing 3 and a rear housing 5 and is connected thereto by bolts 7.

A crankshaft 11 passes through the front housing 3. The crankshaft 11 includes a power-transmitting portion 11*a* connected to a power-transmitting means, such as a pulley (not shown), a sealing portion 11*b* for arranging a sealing device 12, a bearing portion 11*c* provided with a radial bearing unit 13, a balance weight portion 11*d* for correcting a dynamic unevenness generated by the rotating portions, and a crank portion 11*e* which has a central axis $O_2$ which is spaced from the axis $O_1$ of the crankshaft by a predetermined distance of $\rho$. The crank portion 11*e* is fitted, via a radial bearing unit 15, to a central opening 2*c* in a central boss portion 2*a* of the movable scroll member 2. Thrust bearing units 21 and 22 are arranged on the front and rear sides of the balance weight portion 11*d* so that the thrust force applied to the movable scroll member 2 is received by the bearing units 21 and 22.

Figure 2:
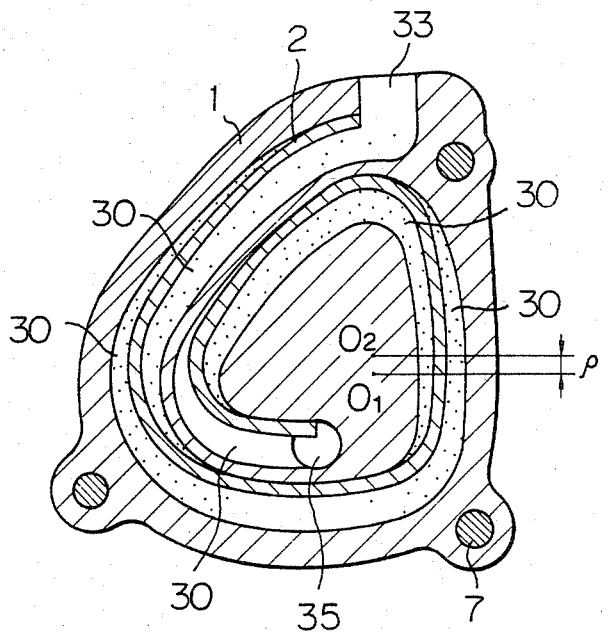
FIG. 2 is a transverse cross-sectional view along the line II—II in FIG. 1 of the embodiment of FIG. 1.

As is shown in FIG. 2, the movable scroll member 2 contacts the stationary scroll member 1 so that chambers 30 are formed therebetween. The movable scroll member 2 rotates about an axis $O_1$ of the crankshaft 11 without rotating about its own axis $O_2$. During the rotation of the movable scroll member 2 about the axis $O_1$, contact between the movable scroll member 2 and the stationary scroll member 1 is maintained.

Figure 3A:
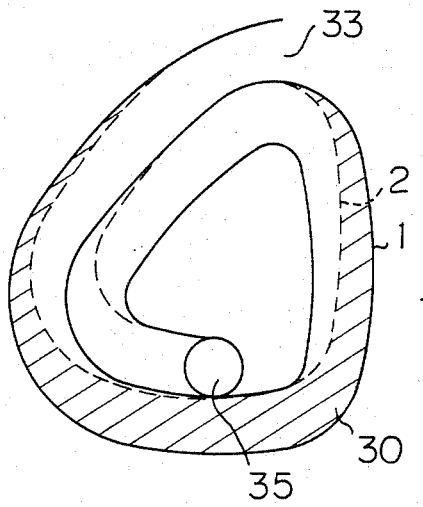
FIGS. 3A through 3D are diagramatic views of the position of the movable scroll member of the present invention with respect to the position of the stationary scroll member at angles of 0°, 90°, 180°, and 270°, respectively.
Figure 3D:
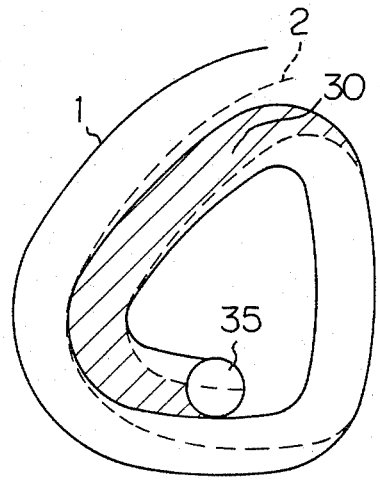
Figure 3B:
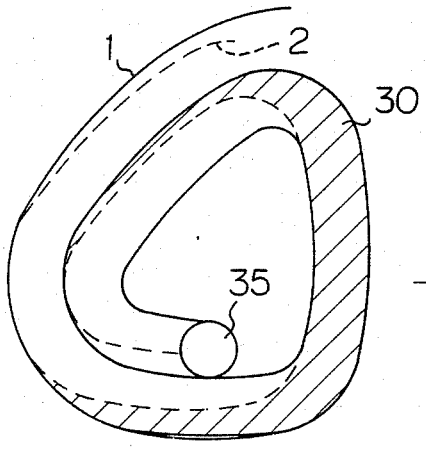
Figure 3C:
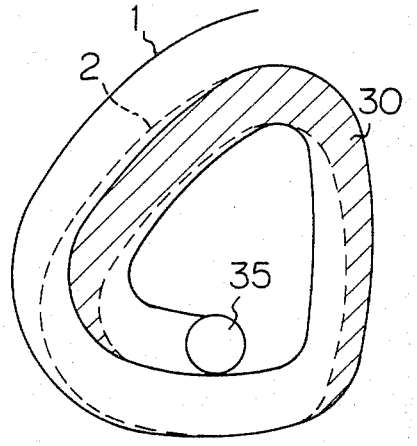

FIGS. 3A through 3D respectively show the position of the movable scroll member 2 with respect to the position of the stationary scroll member 1 when the angular displacement of the movable scroll member 2 is 0°, 90°, 180°, and 270°, respectively. In the hatched chamber 30 in FIGS. 3A through 3D, the volume of the chamber 30 is gradually decreased as it circumferentially moves while being radially directed inwardly. In FIG. 3A, the fluid to be compressed is confined in the closed chamber 30. At a position preceeding the position of the movable scroll member 2 in FIG. 3A, the chamber 30 is open to a suction pipe 33 (FIG. 2) formed in the rear housing 5 so that the above-mentioned fluid is introduced thereinto. The fluid thus sucked is then gradually subjected to compression in the hatched chamber at the position of the movable scroll member 2 in FIGS. 3B and 3C. Finally, at the position of the movable scroll member in FIG. 3D the fluid thus compressed is forced out of the chamber 30 because the chamber 30 is opened to a central outlet port 35 (FIGS. 1 to 3) formed in the stationary scroll member 1. The outlet port 35 has, as this type of pump usually does, a reed-valve type of check valve 37 (FIG. 1) so that the fluid is introduced, when the check valve is opened, via a delivery pipe 39 (FIG. 1) to the air-conditioning device.

In this embodiment the configuration of the stationary and movable scroll members is determined as is described below.

Figure 4:
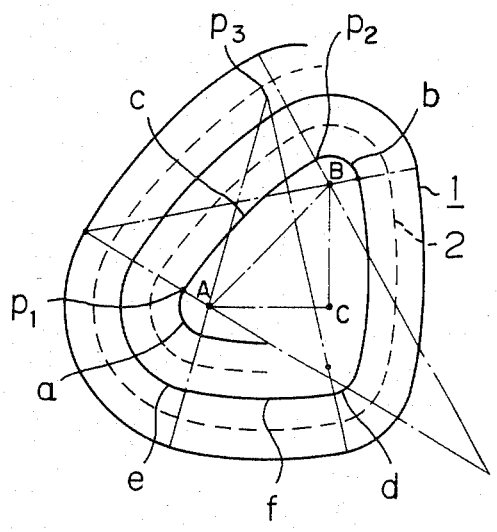
FIG. 4 shows a means of shaping a scroll member based on a triangle.

As FIG. 4 shows, first, a triangle ABC as a base formed. Then outwardly convexed small arcs a and b are formed above the corners A and B of the triangle. These arcs a and b are connected to each other by an outwardly convexed arc c having a large radius. For example, the arc a and the arc b have the same radius and are smoothly connected to each other by the large-radius arc c. In order to attain a smooth connection, it is necessary at the connection points $p_1$ and $p_2$ between the arcs a and b and the arc c that a tangential line of the arc a or b correspond to a tangential line of the arc c.

In a case where small arcs of a different radius, for example, the arc d and the arc e, are connected they are smoothly connected by a single arc f. In this case, the small arcs d and e have a different radius, and, therefore, the center $p_3$ of the large-radius arc f should be so positioned that the small arcs d and e can be smoothly connected to each other.

After the shape of the stationary scroll member 1 is formed, the shape of the movable scroll member 2 can be formed by displacing the shape of the stationary scroll member 1 for a distance $\rho$ along the normal direction of the curve of the stationary scroll member 1. As can be seen the scrolling of scroll member 1 and 2 extend for more than 360° in an outward direction as the scroll members turn.

According to the pump of the present invention, the adjacent small arcs are connected to each other by a curve instead of a straight line. Therefore, the fluid is compressed gradually, and a pump which operates efficiently is obtained. Further, an advantage is obtained in that even if the movable scroll member 2 slightly rotates about its own axis $O_2$ due to tolerances, it does not contact the stationary scroll member 1.

Figure 5A:
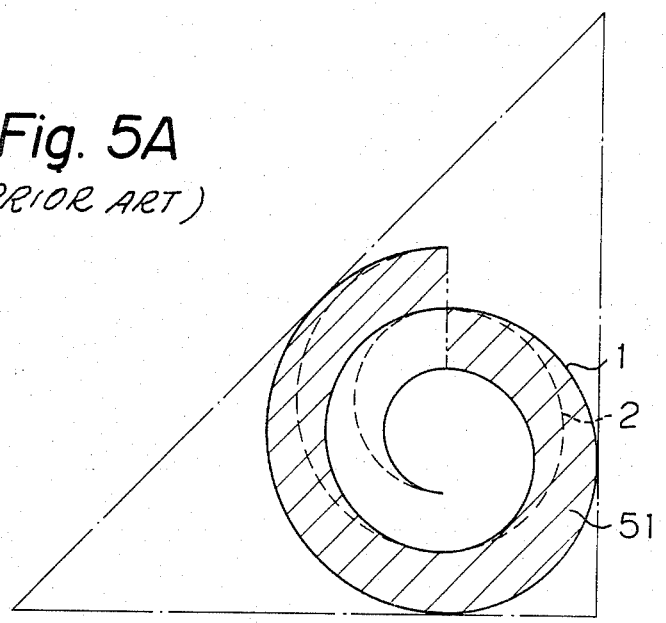
Fig. 5A (PRIOR ART)
FIGS. 5A and 5B show the difference in the pump volume between the present invention (FIG. 5B) and the prior art (FIG. 5A) when a pump is arranged in a triangular space.
Figure 5B:
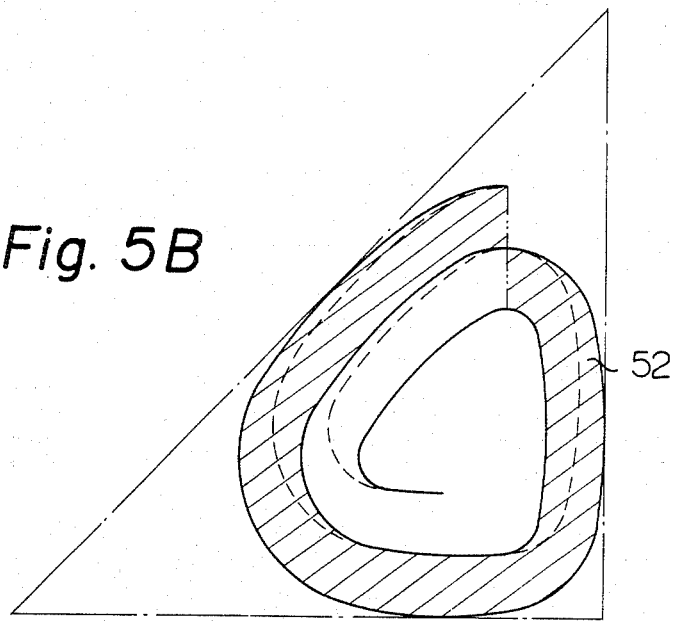

Further, according to the present invention, the cross-sectional shape of the scroll-type pump is, generally, a triangle shape because the shape of the scroll members 1 and 2 is based on a triangle shape. Therefore, when the space wherein the pump is to be housed is of a trigonal shape, the volume of the pump can be larger than when the shape of the scroll member is circular. This is explained with reference to FIG. 5A and FIG. 5B by using a numerical value. Assume that space of a trigonal shape is given, the crosssection thereof being a right angle isosceles triangle having a long side of a length of 140 mm. The volume of the triangle-shaped pump is compared with the volume of a circular-shaped pump. In both pumps, the eccentric distance $\rho$ is the same, i.e., 5 mm.

In the case of the circular-shaped pump, the corss-sectional area (FIG. 5A) of the closed space indicated by the hatched portion 51 is expressed by the following equation:

$$A=\pi/8(61^2-41^2+51^2-31^2)=1445\ mm^2$$

In the case of the triangle-shaped pump, the cross-sectional area (FIG. 5B) of the closed space indicated by the hatched portion 52 is expressed by the following equation:

$$B=5/12\pi(25^2-15^2)+5/12\pi(15^2-5^2)+\pi/12(80^2-70^2)+\pi/12(73^2-63^2)+10\times 20=1734\ mm^2$$

Since B/A = 1.20, a 20 percent increase in the volume of the pump is obtained by changing the shape of the scroll member from that based on a circular shape to that based on a triangle shape.

In summary, a pump having a pump chamber of a predetermined shape makes it possible to increase the volume of the pump in the case of a scroll member based on a right angle triangle because it is assumed that the predetermined space is a trigonal prism. The present invention makes it possible to obtain, in addition to a triangle shape, various shapes of scroll members.

Figure 6:
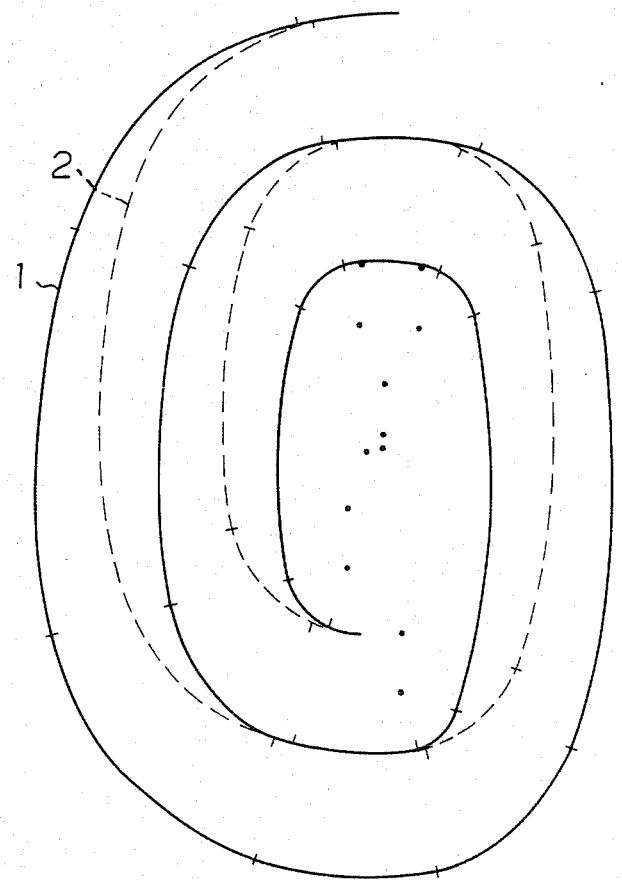
FIG. 6 is another embodiment of a shape of a scroll member based on a vertically elongated rectangle.

As is shown in FIG. 6, scroll members may have a shape based on a rectangle. Further, scroll members may have a shape based on a predetermined polygon or a shape other than a polygon. By selecting a scroll shape corresponding to the shape of the predetermined space, a scroll-type pump having a large volume can be obtained.

Figure 7:
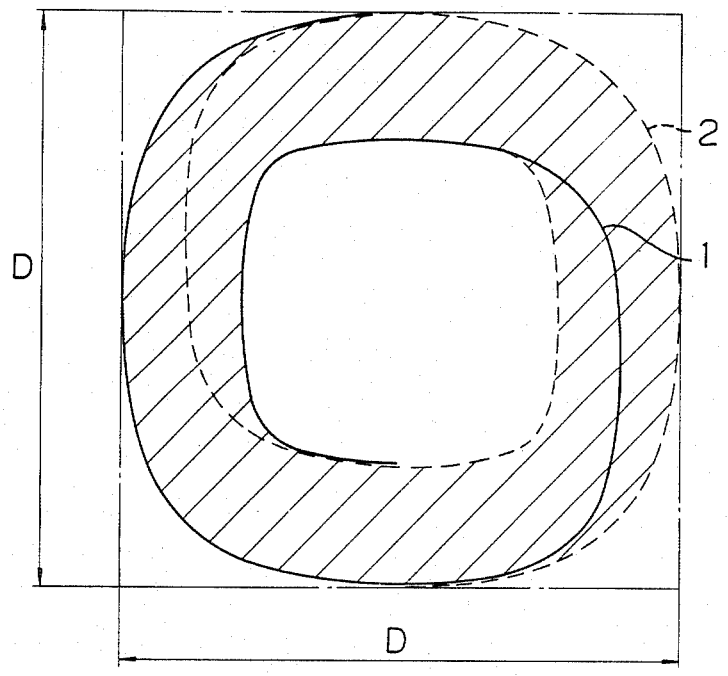
FIG. 7 shows a scroll shape based on a regular rectangle.

In the above-mentioned embodiment, the shape of the movable scroll member 2 and the shape of the stationary scroll member 1 are different. However, as is shown in FIG. 7, the scroll member 1 and the scroll member 2 may have the same shape but a different phase at 180°. The pump in FIG. 7 makes it possible to increase the volume thereof since it is arranged in a space shaped as an ordinary square having sides of a length of D and extends to points near the corners of the space. Thereby, the space is effectively used.

If the rectangular cross-sectional shape of the predetermined space is made flatter, i.e., if the shape of the pump is changed from a circular one to a rectangle one, the volume of the pump is increased.

Figure 8:
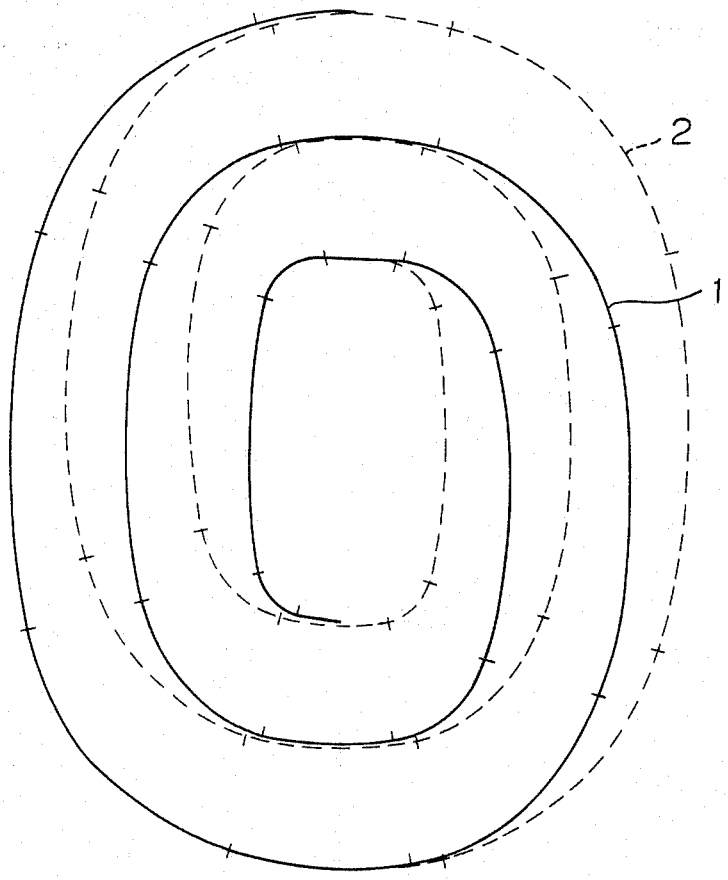
FIG. 8 shows a shape of a scroll based on a vertically elongated rectangle.

FIG. 8 shows a pump having the same shape as the pump in FIG. 7 except that the vertical length thereof is elongated. Such an oblong type of pump is advantageous when housed in an engine room of the passenger car.

In the above-mentioned embodiments, the scroll members 1 and 2 are based on an arc. However, another type of curved line, such as an involute line, may be used.

The present invention makes it possible to attain the effects mentioned below.

First, a smooth flow of fluid without any stagnation is realized because the curved lines of a small radius of the scroll members are connected to each other by curved lines of a large radius instead of by a straight line. As a result, the amount of torque necessary for operating the pump is decreased so that a high-efficiency pump having a small amount of vibration and producing a small amount of noise is obtained.

On the contrary, in a pump where a straight line connects adjacent curved lines of a small radius, the distance between parallelly spaced surfaces is small when the surfaces are closed at the ends thereof so as to confine a fluid therebetween. Therefore, the fluid is apt to be forced toward the open ends of the surfaces, thereby increasing the flow resistance. Particularly, when the distance between the parallelly spaced surfaces became very small, the flow resistance is greatly increased, resulting in an increase in the torque for operating the pump, as well as the generation of noise and vibration. Further, fluid leaks on the sealing side, i.e., the closed ends of the surfaces, causing the pump volumetric efficiency to decrease. In the present invention, these drawback are prevented.

The present invention makes it possible for the movable scroll member not to impinge on the stationary scroll member when the movable scroll member undergoes slight rotation about its own axis due to an inevitable clearance which is necessary to absorb thermal expansion, and which is necessary to attain a tolerance of the mechanism for prevention of autorotation of the movable scroll member. If the curved-line sections are connected to each other by a straight line, the movable scroll member impinges on the stationary scroll member even if the straight-line section of the movable scroll member is slightly inclined, i.e., if the movable scroll member 2 rotates about its own axis. Contrary to this, in the present invention, there is no possibility of the scroll members impinging each other because they are based on a curved line. Thus, the present invention makes its possible to increase the pump's resistance to rupture.

Many modification and changes may be made by those skilled in the art without departing from the scope of the present invention.

We claim:

1. A scroll-type pump comprising:

a housing assembly;

a stationary scroll member having scrolling extending greater than 360° and a generally polygonal shape, and being fixedly arranged in said housing assembly;

a movable scroll member having scrolling extending greater than 360° and a generally polygonal shape and being movably arranged in said housing assembly;

said housing assembly having an outer shape which is similar with said polygonal shape of said scroll members;

means for supporting said movable scroll member in such a manner that said movable scroll member rotates around an axis other than its own axis while maintaining contact with said stationary scroll member;

chambers being formed between said stationary scroll member and said movable scroll member, each chamber moving circumferentially and radially inward while the volume thereof is gradually decreased when said movable scroll member rotates;

means for introducing fluid into each chamber when the volume thereof is large; and means for removing fluid from each chamber when the volume thereof is small;

each scroll member having a shape which corresponds to a curve and each scroll member extending, in a plane transverse to the axis thereof, outwardly while turning about an axis other than its own axis, said curve being comprised of radially outwardly convexed arc sections of a small radius and radially outwardly convexed arc sections of a large radius alternately arranged in the direction along which each scroll member extends and being smoothly connected to each other.

2. A scroll-type pump according to claim 1, wherein at each point where a small-radius section and a large-radius section adjacent to each other are connected to each other, said sections have the same tangential line.

3. A scroll-type pump according to claim 1, wherein the shapes of said scroll members are different from each other.

4. A scroll-type pump according to claim 1, wherein said scroll members have the same shape, while they are angularly displaced at a phase of 180°.

5. A scroll-type pump according to claim 1, wherein said each shape is formed from a triangle.

6. A scroll-type pump according to claim 5, wherein said triangle is a right angle isosceles triangle.

7. A scroll-type pump according to claim 1, wherein said polygon is a quadrilateral.

8. A scroll-type pump according to claim 7, wherein said quadrilateral is a square.

9. A scroll-type pump according to claim 7, wherein said quadrilateral is an elongated rectangle.

10. A scroll-type pump according to claim 1, wherein said pump is adapted for use as a compressor in an air-conditioning system for a vehicle.

* * * * *